US006185786B1

(12) United States Patent
Garcia

(10) Patent No.: US 6,185,786 B1
(45) Date of Patent: Feb. 13, 2001

(54) ERGONOMIC CUSHIONING DEVICE FOR INHIBITTING INJURY

(76) Inventor: Richard J. Garcia, 14097 Ave. 272, Visalia, CA (US) 93292

( * ) Notice: Under 35 U.S.C. 154(b), the term of this patent shall be extended for 0 days.

(21) Appl. No.: 09/259,667

(22) Filed: Feb. 26, 1999

(51) Int. Cl.[7] ..... E05B 1/00

(52) U.S. Cl. ..... 16/430; 16/421; 16/441; 74/543

(58) Field of Search ..... 16/441, 422, 435, 16/431, 433; 74/543, 523, 473.1, 551.8, 551.9

(56) References Cited

U.S. PATENT DOCUMENTS

| | | | | |
|---|---|---|---|---|
| 574,755 | * | 1/1897 | Oehler | 16/433 |
| 619,223 | * | 2/1899 | Ramey et al. | 16/421 |
| 1,443,596 | | 1/1923 | Schaefer | 16/441 |
| 1,556,966 | | 1/1925 | Selig | 16/441 |
| 1,632,227 | | 6/1927 | Halsey | 16/421 |
| 2,449,575 | * | 9/1948 | Wilhelm | 16/441 |
| 3,742,204 | * | 6/1973 | Price | 74/543 |
| 3,795,156 | * | 3/1974 | Neuscheler | 74/543 |
| 4,706,598 | * | 11/1987 | Jeffress | 16/422 |
| 4,896,556 | * | 1/1990 | Takada | 74/523 |
| 5,305,660 | * | 4/1994 | Hasegawa | 74/553 |
| 5,740,586 | * | 4/1998 | Gomas | 16/436 |

* cited by examiner

*Primary Examiner*—Chuck Y. Mah
(74) *Attorney, Agent, or Firm*—Dennis B. Haase

(57) ABSTRACT

A cushioning device adapted to circumscribe the handle of a vice or the like to inhibit injury to the user's hand during tightening and losing thereof, wherein a pair of cups are provided in which an insert is provided which conforms to the shape of the handle and is formed of a sturdy yet pliable material that holds its shape, and a shell of soft deformable material, and further wherein the insert is nested in the shell, and two such cups are secured together to circumscribe the handle to provide cushioning in use.

6 Claims, 2 Drawing Sheets

ERGONOMIC CUSHIONING DEVICE FOR INHIBITTING INJURY

The present invention relates to improvements in a cushioning device, ergonomically designed to permit use of machine devices such as, for example, a vice, while avoiding, or at least inhibiting, injury to the palm and digits of the user's hands while attempting to loosen or tighten the vice.

BACKGROUND OF THE INVENTION

1. Field of the Invention

It has been common practice since the memory of man runneth not to the contrary, for persons in using a vice type apparatus for holding a workpiece to use their hands to hit the elongate handle which loosens and tightens the jaws of the tool about the work piece to obtain the best grip or quickly loosen that grip.

Whether the user is a rank amateur or an experienced machinist, sooner or later an injury results, and it may take one or more of several forms, e.g., Carpal Tunnel Syndrome, Repetitive Stress Injury, median nerve damage, or simply contusions of one's hand in the area of the palm or fingers, or both, results. To the amateur, it probably means a day or two delay in going forward with the project, whatever it might be. For the professional, it may well mean lost work time, a trip to a medical facility and, perhaps, serious damage.

To the employer, it is lost productivity, perhaps a delay in completion of an essential task, which could delay delivery of a job and getting paid for that job. Further, and as is well known to all employers, it becomes an accident and, as all employers are painfully aware, a consideration when it is time to reevaluate one's workman's compensation insurance.

All of the foregoing practical considerations are exacerbated by the personal discomfort and inconvenience which is heaped on someone with an injury to a hand, and particularly if it is one's major.

It is increasingly recognized that even seemingly minor injuries of the type described can have unexpected and far reaching repercussions, which can sometimes, but not always, be measured in terms of dollars and cents, and it is the non monetary complications which often pose the harder to solve problems.

2. Overview of the Prior Art

While the problem articulated above has existed since perhaps the days of medieval torture chambers, or at least since the invention of the printing press which called for a large platen to be screwed down against a piece of parchment by hand, it took on practical significance with the dawning of the industrial age and has become a serious problem in the current environment of high productivity, injury abatement and the ever present insurance adjuster.

The concerns articulated here have been existent for years, and early in the industrial revolution it was not uncommon for workers to wrap the vice handles, or their hands, with shop rags, or tape, or both, to mitigate the pain.

It is evident from the early patents which attempted to alleviate human suffering by making the manipulating of everyday tools more user friendly. In Schaefer U.S. Pat. No. 1,443,596, for example, the inventor perceived a problem in the use of common household implements such as mops, brooms and the like. However, the perception was that the ends of the handles for such implements scratched furniture and broke glass. Mr. Schaefer's solution was to place a soft bulb, or cup, over the end of the handle. Hardly compatible with industrial problems, but nonetheless an effort.

Selig U.S. Pat. No. 1,556,966 is a variation on the Schaefer theme, providing a variety of different shapes and sizes to accommodate various implements, a concept which is inapposite to that of the present invention.

Halsey, in his U.S. Pat. No. 1,632,227 focused on an ice pick, and he, for the first time on the record, exhibited concern for the user's hand. Finally, and perhaps of lesser interest, is a flexible gripping sleeve for a socket extension as seen in De Vrou U.S. Pat. No. 4,004,476.

With the foregoing as background, it is evident that none of these efforts have provided industry with the solution it seeks as a means of cutting into the rash of industrial accidents that have become the bane of an employer's existence, at least not until now.

SUMMARY OF THE INVENTION

Having established the environment within which the present invention has particular, although clearly not exclusive utility, the present invention seeks to inhibit hand injuries resulting from efforts to either loosen or tighten a vice by striking the handle thereof with one's hand.

It is, therefore, an objective of the present invention to provide employers and users alike with a very inexpensive, yet versatile aftermarket device which will protect the user of a vice, or the like, from inadvertent injury without inhibiting the user's ability to effectively use and operate the device.

Another objective is to provide a single pliable, yet effective means of protecting the hand of a user against the unforgiving metal handle of a vice when he attempts to loosen or tighten the same by striking the handle with his hand, and, further, to construct such devices so as to make it essentially universal in its application.

Yet another objective of the present invention is to construct a protective device for the handle of a vice or the like which is ergonomically shaped to conform to the user's hand without impairing the effectiveness of the machine element to which it is applied.

Another and still further objective of the present invention is to provide a measure of protection to other persons in close proximity to a vice or the like, from being more seriously injured by the end of the handle of a vice being opened or closed by inadvertent, unintended contact with such handle. In this same vein, the vice handle will tend to swing about when loose, and there have been instances when the end of that handle will make inadvertent contact with the mill table, or some other component of the machine itself, and while such contact does not rise to the concern for the protection of human needs, it is nonetheless a serious concern, and one which is well mitigated by the present invention.

The accomplishment of these, as well as other objectives and advantages of the present invention, will become apparent from a reading of the detailed description of a preferred embodiment, when taken in conjunction with the accompanying drawing, wherein:

DETAILED DESCRIPTION OF A PREFERRED EMBODIMENT

Figure 1:
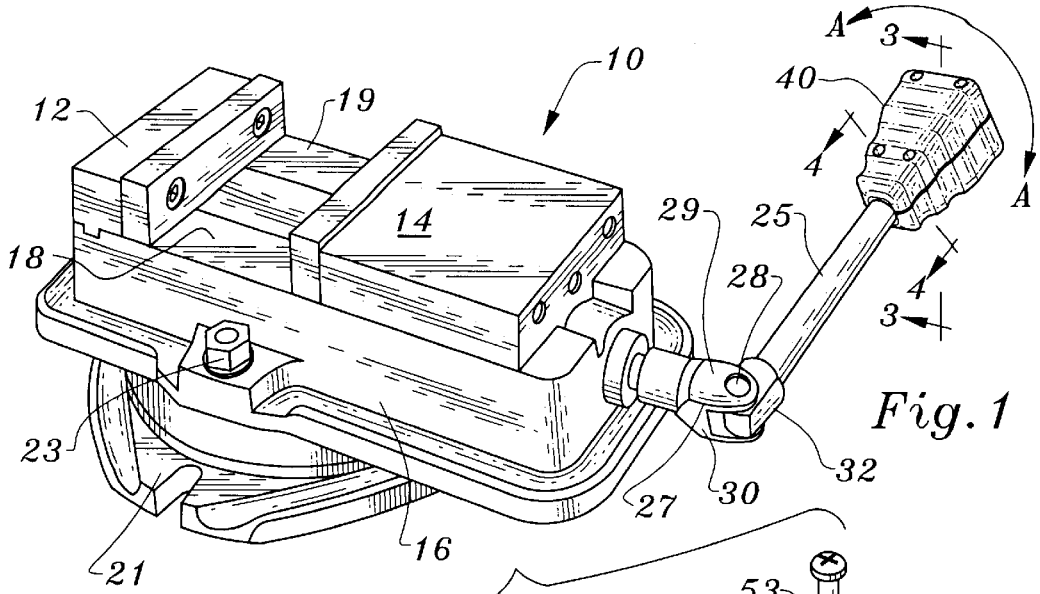
FIG. 1 is a pictorial depiction of a typical vice type apparatus for holding a work piece relative to a machine tool in which the jaws of the vice are moved toward and away from one another by manual rotation of a handle, and illustrating a cushioning device constructed in accordance with the present invention and secured in its operative position to the handle of the vice.

With reference now to the drawings, and initially to FIG. 1, there is illustrated, pictorially, a typical vice 10, having jaw halves 12 and 14, one of which may or may not be fixed, such as jaw half 12, relative to a base 16. The jaw half 14 in this illustrative case, is movable on tracks or rails 18 and 19, formed with or affixed to, the base 16. The vice is illustrated as positioned on an adjustable, swivel table 21, by any one of a variety of well known fasteners 23, relative to a machine tool, not illustrated since the sheer numbers and variations of such tools are great, and the type of tool has no bearing on the invention. The swivel base may then be fixed relative to the machine tool in any well known manner.

The jaw halves are moved toward and away from one another by a device such as a worm gear or a screw, disposed between the rails 18 and 19, and the device is manually rotated by a handle 25, which in the illustration, attaches to the rotatable device by means of a fork bolt 27. A pin 28 extending between the ends 29 and 30 of the fork bolt passes through the inner terminal end 32 of the handle 25 such that the handle has limited rotational movement long the path A—A which is transverse to the axis of the pin 28.

The present invention is directed to attenuation of injuries which are indigenous to the customary manner employed almost universally by those who regularly use devices such a the vice 10. It will be apparent that the handle 25 is elongate in order to provide an increased lever arm which permits the user to multiply the closing or opening forces that are applied to the jaw halves 12 and 14.

Seemingly, however, no matter how long the handle, it is never quite long enough to permit the user to assert the kind of force that the user perceives to be necessary to secure a work piece between the jaws, or later release it. In fact, the length of the handle is governed by safety and space considerations, and the user is relegated to the limits of his or her ingenuity in applying the requisite force to the handle. Some have tried to increase leverage by placing a long pipe over the handle. However, that requires both a pipe and some extra time. Further, there is an element of safety to be considered, and it is not a means favored by most users.

In fact, the most common, indeed pervasive, method of applying force to the handle 25, is to hit it with one's hand, or more particularly the heal of the palm of one's hand. This method is so common in the industry that manufacturers of vice type devices have configured the outer terminus 34 of the handle so as to be enlarged and bulbous, so as to replicate, insofar as may be reasonable, the shape of a cupped hand. Accordingly, and with reference to FIGS. 2 and 5, in one configuration the terminus 34 is in a ball or spherical configuration such as at 36. Yet in FIG. 6, the handle, while rounded, tends toward a pear or bulbous shape. Other such shapes are within the contemplation of the invention, but these are illustrative of the most common.

Notwithstanding these accommodations from the manufacturer, users persist in injuring their hands by pounding on the end of the handle to get more force on the jaws and, thus, the work piece. The reality is that even in the most grizzled worker, the palm of the hand is relatively soft; not given to callous easily, and is prone to injury when used as a hammer. It is to this seeming stalemate between reality and expediency that the present invention is directed.

Figure 2:
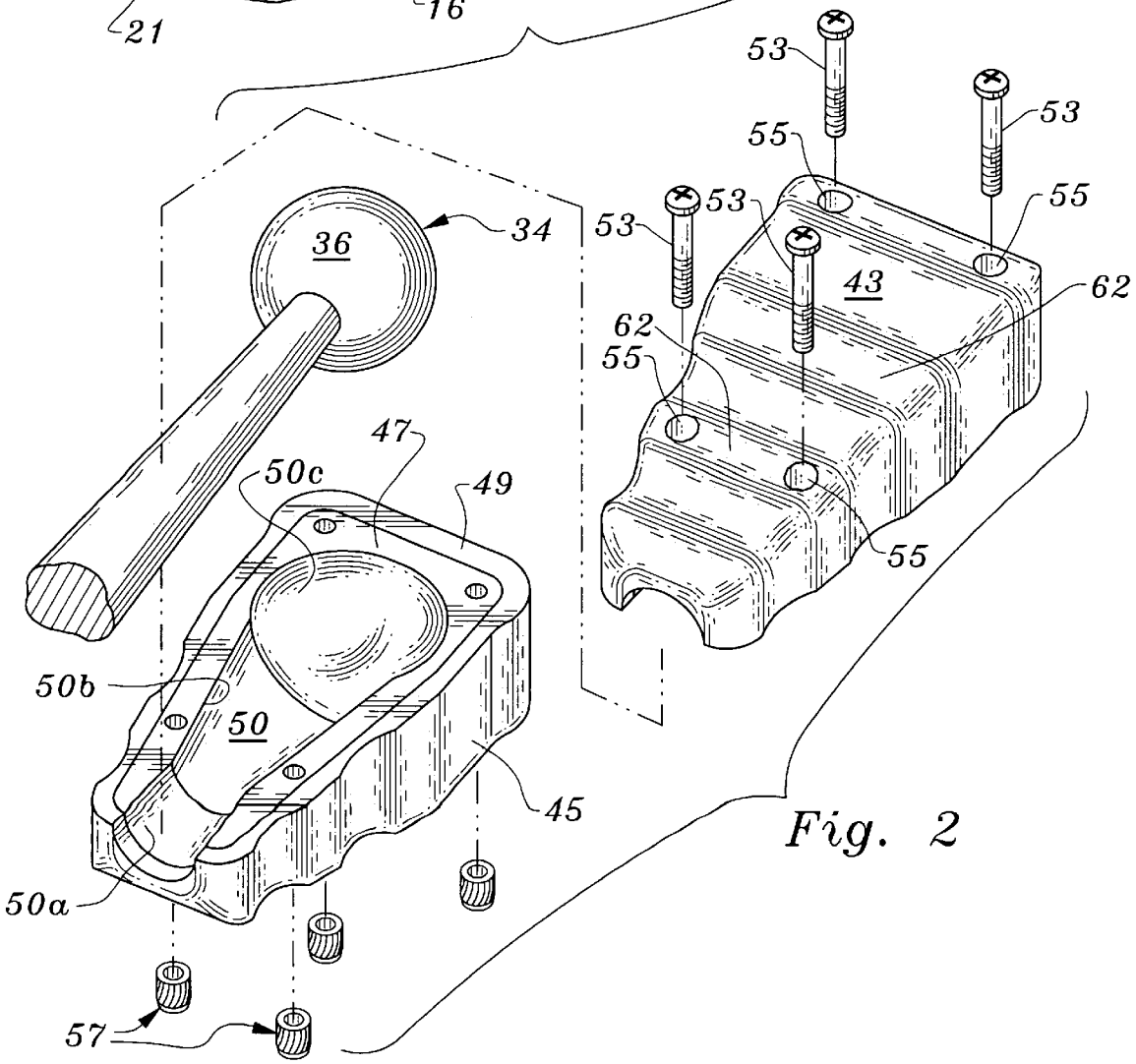
FIG. 2 is an exploded view of the cushioning device of the present invention positioned in relation to a typical handle of a vice such as the vice of FIG. 1.

In accordance with the invention, a cushioning device 40 has been developed which provides a welcome intercession between a steel hard handle 25 and the much softer, palm area of the user's hand. With reference especially to FIG. 2, a cushioning device 40 is illustrated in some considerable detail. Specifically, there is shown a pair of cup like members 43 and 45, which are substantially identical in their structure and size in order that they may be interchangeable in use.

So as to permit use with any particular vice handle 25, each cup 43 and 45 has a pliable, yet sturdy, insert 47, which is constructed to nest snugly in an outer shell 49. The insert is so constructed of a material which has sufficient firmness as to hold its shape relative to the handle whereas, or in contrast, the outer shell 49 may be molded or otherwise formed of a variety of well recognized soft, deformable materials, including, but clearly not limited to, open and closed cell foam materials and a variety of plastics, and perhaps even foam backed leathers or vinyls, to the extent that such may be economically feasible, and so long as the material is suitable to accomplishment of the objectives of the invention.

The exterior of the insert 47, and the interior of the shell 49 are compatible and matched in order that they fit snugly with the insert nested in the shell. The interior of the insert defines a versatile, essentially universal, cavity 50, which is molded or otherwise formed to accommodate several handle terminus configurations, e.g., the ball end 36. In the illustrated case, the cavity 50 accommodates both the FIG. 5 and FIG. 6 configurations, which are currently the two most commonly in use.

One of the objectives of the present invention is to provide a cushioning device which is especially functional in that it has the characteristic of universality of fit, without sacrifice to utility. Fortunately, strength of materials and operational considerations, for example, space, dictate certain minimum parameters which are common between existing designs.

Indeed, as previously pointed out, the great majority of vise type devices have one of two types of handle designs. One such handle, as illustrated in FIG. 5, consists of a tapered shaft with a ball 36, which may be formed with, but is more typically threaded onto, the handle 25, at its end.

Figure 6:
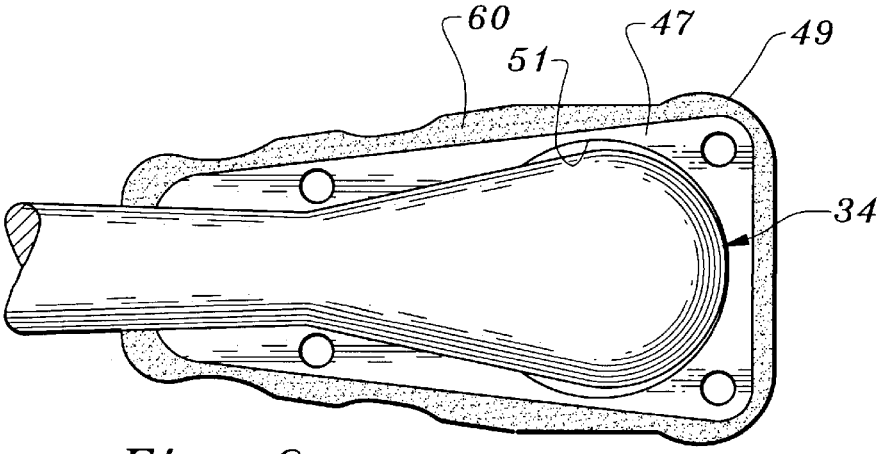

Another popular handle, as shown in FIG. 6, is typically a one piece casting that comprises a cone shaped taper that merges into a slightly smaller ball. It is a feature of the present invention that the shape of the cavity halves, when joined, will circumscribe, in a secure manner, both of these commonly used vice handles.

Figure 5:
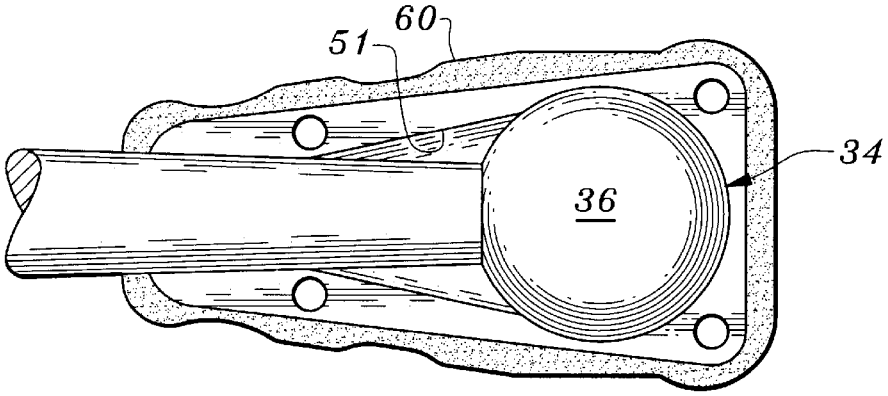
FIG. 5 is a sectional view such as seen in FIG. 3, and illustrating one typical configuration of a vice handle in which the handle terminates in a spherical shape; and, FIG. 6 is a view such as FIG. 5, in which the vice handle terminates in a pear shape.

As shown in FIGS. 5 and 6, and perhaps others, each cavity half in the insert consists of two converging cones intersecting a spherical cavity. The first section 50*a* of the cavity has an opening adapted to receive a portion of the taper of the handle. It has a conical shape with approximately a 1½° of taper section. This is intended to accommodate the taper of the handle. The diameter of this cone uniformly decreases in size to the point where it intersects an intermediate section 50*b*. The intermediate section, in a similar fashion, uniformly increases in size to, for example, a radius which will accommodate the spherical end of the handles where it intersects and joins an end section 50*c*.

Figure 3:
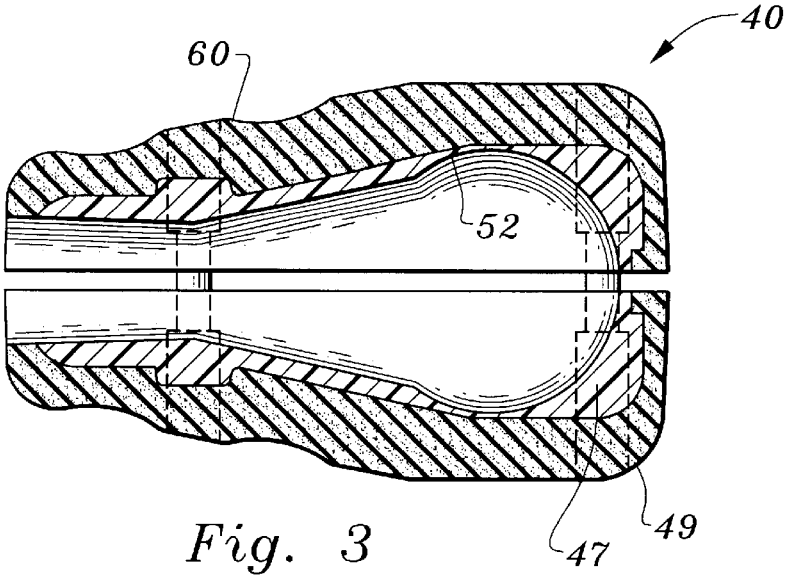
FIG. 3 is a sectional view of a typical vice handle, sectioned in a vertical plane 3—3 of FIG. 1, and illustrating interrelation of the handle and cushioning device of the present invention in that plane.
Figure 4:
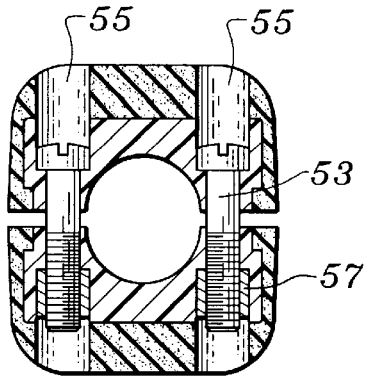
FIG. 4 is a sectional view of the vice handle and cushioning device taken along 4—4 of FIG. 1.

The cups 43 and 45 are adapted to interact with one another to form a close fitting chamber, or enclosure, 51 circumscribing the terminal end 34 of the handle when they are fitted in face to face relation thereabout, as seen in FIGS. 1, 3 and 4. The cups are fitted together and secured in face-to-face relation by fasteners 53. The fasteners are received in recessed relation in bores 55 in order that no part of the fastener is sufficiently exposed to be struck by the user's hand. The bores are arranged in pairs, one pair of which being outward of the terminal end 34 of the handle, and another pair inwardly thereof, so as to secure the cups against movement relative to the handle once in place thereon. Further, in order that the material from which both the insert and shell are made may provide optimum softness to protect the user against injury, nuts 57 are inserted into the recesses to receive and secure the threaded ends of each of the fasteners 53.

Further in keeping with the invention, the overall exterior configuration of the cushioning device is reminiscent of a truncated pyramid, and in order to provide better gripping, the outer surfaces 60 are formed, or otherwise provided with softly rounded ridges or ribs 62. The foregoing construction tends to fit the user's hand in a predetermined position on the cushioning device and, further, inhibits inadvertent disengagement therefrom during normal usage.

In operation, a highly functional cushioning device 40 is provided which accommodates any of several vice handles and accomplishes all of the objectives of the present invention with maximum ease and minimum expense, thereby materially enhancing the use of vice like devices such as illustrated, as well as many other similar devices.

Having thus provided a detailed description of a preferred embodiment, what is claimed is:

1. In a tool, said tool having a handle for manually tightening and loosening said tool, and wherein said tool terminates in a bulbous end;

a universal accessory for selective attachment to said handle, said accessory comprising:

a pair of cup like members, each said member comprising an outer shell; said outer shell housing an insert therein;

said insert adapted to be nested in said shell and having an interior cavity formed therein, said cavity substantially conforming to said bulbous terminal end of said handle;

said pair of cups being interconnected about said handle to define a cushion thereabout.

2. The universal accessory of claim 1, wherein said cups are formed with bores there through, said bores receiving fasteners in recessed relation therein so as to secure said pair of said cups together to form a cushion about the handle.

3. The universal accessory of claim 2, wherein four bores are provided in each cup.

4. The universal accessory of claim 1, wherein said insert is formed of a moldable but otherwise non deformable material and said shell is made of a deformable material.

5. The universal accessory of claim 1, wherein the exterior surface of said shell is formed with ribs.

6. The universal accessory of claim 5, wherein the exterior surface of said shell has an overall appearance of a truncated pyramid.

* * * * *